US005332456A

United States Patent [19]

Masumoto et al.

[11] Patent Number: 5,332,456

[45] Date of Patent: Jul. 26, 1994

[54] SUPERPLASTIC ALUMINUM-BASED ALLOY MATERIAL AND PRODUCTION PROCESS THEREOF

[75] Inventors: Tsuyoshi Masumoto, 3-8-22 Kamisugi, Aoba-ku, Sendai-shi, Miyagi; Akihisa Inoue, 11-806, Kawauchijutaku, Mubanchi, Kawauchi, Aoba-ku, Sendai-shi, Miyagi; Kenji Higashi, 3-4-9, Teraikedai, Tondabayashi-shi, Osaka; Katsumasa Ohtera, Yamato; Makoto Kawanishi, Kurobe, all of Japan

[73] Assignees: Tsuyoshi Masumoto; Akihisa Inoue, both of Miyagi; Kenji Higashi, Osaka; Yoshida Kogyo K.K., Toyko, all of Japan

[21] Appl. No.: 951,197

[22] Filed: Sep. 25, 1992

[30] Foreign Application Priority Data

Sep. 26, 1991 [JP] Japan ..... 3-247523
Dec. 6, 1991 [JP] Japan ..... 3-323178

[51] Int. Cl.[5] ..... C22F 1/00

[52] U.S. Cl. ..... 148/564; 148/695; 148/415; 148/437; 148/438; 148/439; 148/440; 420/528; 420/902

[58] Field of Search ..... 148/437, 438, 439, 440, 148/415, 564, 695; 420/528, 902

[56] References Cited

U.S. PATENT DOCUMENTS 5,053,085 10/1991 Masumoto et al. ..... 148/439
5,171,374 12/1992 Kim et al. ..... 420/902

FOREIGN PATENT DOCUMENTS 0475101 3/1992 European Pat. Off. .

*Primary Examiner*—Richard O. Dean
*Assistant Examiner*—Robert R. Koehler
*Attorney, Agent, or Firm*—Flynn, Thiel, Boutell & Tanis

[57] ABSTRACT

A superplastic aluminum-based alloy material consisting of a matrix formed of aluminum or a supersaturated aluminum solid solution, whose average crystal grain size is 0.005 to 1 μm, and particles made of a stable or metastable phase of various intermetallic compounds formed of the main alloying element (i.e., the matrix element) and the other alloying elements and/or of various intermetallic compounds formed of the other alloying elements and distributed evenly in the matrix, the particles having a mean particle size of 0.001 to 0.1 μm. The superplastic aluminum-based alloy material is produced from a rapidly solidified material consisting of an amorphous phase, a microcrystalline phase or a mixed phase thereof by optionally heat treating the material at a prescribed temperature for a prescribed period of time and then subjecting it to a single or combined thermomechanical treatment. The superplastic aluminum-based alloy material of the present invention is suited for superplastic working.

18 Claims, 2 Drawing Sheets

SUPERPLASTIC ALUMINUM-BASED ALLOY MATERIAL AND PRODUCTION PROCESS THEREOF

BACKGROUND OF THE INVENTION

1. Field of Invention

This invention relates to a superplastic aluminum-based alloy material and a production process thereof.

2. Description of the Prior Art

Various metals or alloys, which exhibit an extraordinary elongation when being subjected to tensile deformation at high temperatures, are known as superplastic metals or alloys. Using the properties of such superplastic metals and alloys, parts having complicated shapes, which have not been easily produced by known processes, can be produced in a single production process and, thus, the superplastic materials are widely used in various industrial applications.

Known superplastic metals or alloys exhibit a large elongation at a strain rate of $10^{-4}$ to $10^{-2}s^{-1}$ (/second) and at a temperature $T>Tm/2$ (i.e., at a temperature higher than their melting point $\times\frac{1}{2}$ in terms of absolute temperature) and, thus, they are applicable for working at a relatively low strain rate. However, the known metals or alloys have difficulties in working at a relatively high strain rate exceeding $10^{-1}s^{-1}$.

SUMMARY OF THE INVENTION

It is accordingly an object of this invention to provide superplastic aluminum-based alloy materials which have a high strength and are suitable for working at a relatively high speed, such as high-speed forging, high-speed bulging, high-speed rolling, high-speed drawing or similar working.

In one aspect of this invention, there is provided a superplastic aluminum-based alloy material consisting of a matrix formed of aluminum or a supersaturated aluminum solid solution, whose average crystal grain size is 0.005 to 1 μm, and particles made of a stable or metastable phase of various intermetallic compounds formed of the main alloying element (i.e., the matrix element) and the other alloying elements and/or of various intermetallic compounds formed of the other alloying elements and distributed evenly in the matrix, the particles having a mean particle size of 0.001 to 0.1 μm.

The above superplastic aluminum-based alloy materials preferably have the following alloy compositions:

(1) A superplastic aluminum-based alloy material consisting of a composition represented by the general formula: $Al_aM_{1b}X_e$, wherein $M_1$ is at least one element selected from the group consisting of Mn, Fe, Co, Ni and Mo; X is at least one element selected from the group consisting of Nb, Hf, Ta, Y, Zr, Ti, rare earth elements and a mixture (Mm: misch metal) of rare earth elements; and a, b and e are, in atomic percentages, $75\leqq a\leqq 97$, $0.5\leqq b\leqq 15$ and $0.5\leqq e\leqq 10$.

(2) A superplastic aluminum-based alloy material consisting of a composition represented by the general formula: $Al_aM_{1(b-c)}M_{2c}Xe$, wherein $M_1$ is at least one element selected from the group consisting of Mn, Fe, Co, Ni and Mo; $M_2$ is at least one element selected from the group consisting of V, Cr and W; X is at least one element selected from the group consisting of Nb, Hf, Ta, Y, Zr, Ti, rare earth elements and a mixture (Mm: misch metal) of rare earth elements; and a, b, c and e are, in atomic percentages, $75\leqq a\leqq 97$, $0.5\leqq b\leqq 15$, $0.1\leqq c\leqq 5$ and $0.5\leqq e\leqq 10$.

(3) A superplastic aluminum-based alloy material consisting of a composition represented by the general formula: $Al_aM_{1(b-d)}M_{3d}X_e$, wherein $M_1$ is at least one element selected from the group consisting of Mn, Fe, Co, Ni and Mo; $M_3$ is at least one element selected from the group consisting of Li, Ca, Mg, Si, Cu and Zn; X is at least one element selected from the group consisting of Nb, Hf, Ta, Y, Zr, Ti, rare earth elements and a mixture (Mm: misch metal) of rare earth elements; and a, b, d and e are, in atomic percentages, $75\leqq a\leqq 97$, $0.5\leqq b\leqq 15$, $0.5\leqq d\leqq 5$ and $0.5\leqq e\leqq 10$.

(4) A superplastic aluminum-based alloy material consisting of a composition represented by the general formula: $Al_aM_{1(b-c-d)}M_{2c}M_{3d}X_e$, wherein $M_1$ is at least one element selected from the group consisting of Mn, Fe, Co, Ni and Mo; $M_2$ is at least one element selected from the group consisting V, Cr and W; $M_3$ is at least one element selected from the group consisting of Li, Ca, Mg, Si, Cu and Zn; X is at least one element selected from the group consisting of Nb, Hf, Ta, Y, Zr, Ti, rare earth elements and a mixture (Mm: misch metal) of rare earth elements; and a, b, c, d and e are, in atomic percentages, $75\leqq a\leqq 97$, $0.5\leqq b\leqq 15$, $0.1\leqq c\leqq 5$, $0.5\leqq d\leqq 5$ and $0.5\leqq e\leqq 10$.

The present invention further provides a process for the production of the aforestated superplastic aluminum-based alloy material, the process comprising:

forming an aluminum-based alloy consisting of an amorphous phase, a microcrystalline phase or a mixed phase thereof, by rapidly quenching an alloy material having a particular composition;

optionally, heat treating the aluminum-based alloy at a prescribed temperature for a prescribed period of time; and subjecting the aluminum-based alloy to a single or combined thermo-mechanical treatment to develop the aforestated microstructure desirable for superplastic working in the resultant aluminum-based alloy material.

The alloy materials to be subjected to rapid quenching have the same compositions as those of the intended superplastic materials and the above-mentioned alloy compositions (1) to (4) are mentioned as preferable examples.

The superplastic aluminum-based alloy materials obtained by the process of the present invention are precisely regulated in the crystal grain sizes of their matrix and the particle sizes of intermetallic compounds dispersed therein and, thereby, they are suited for superplastic working.

DETAILED DESCRIPTION OF THE PREFERRED EMBODIMENTS

Figure 1:
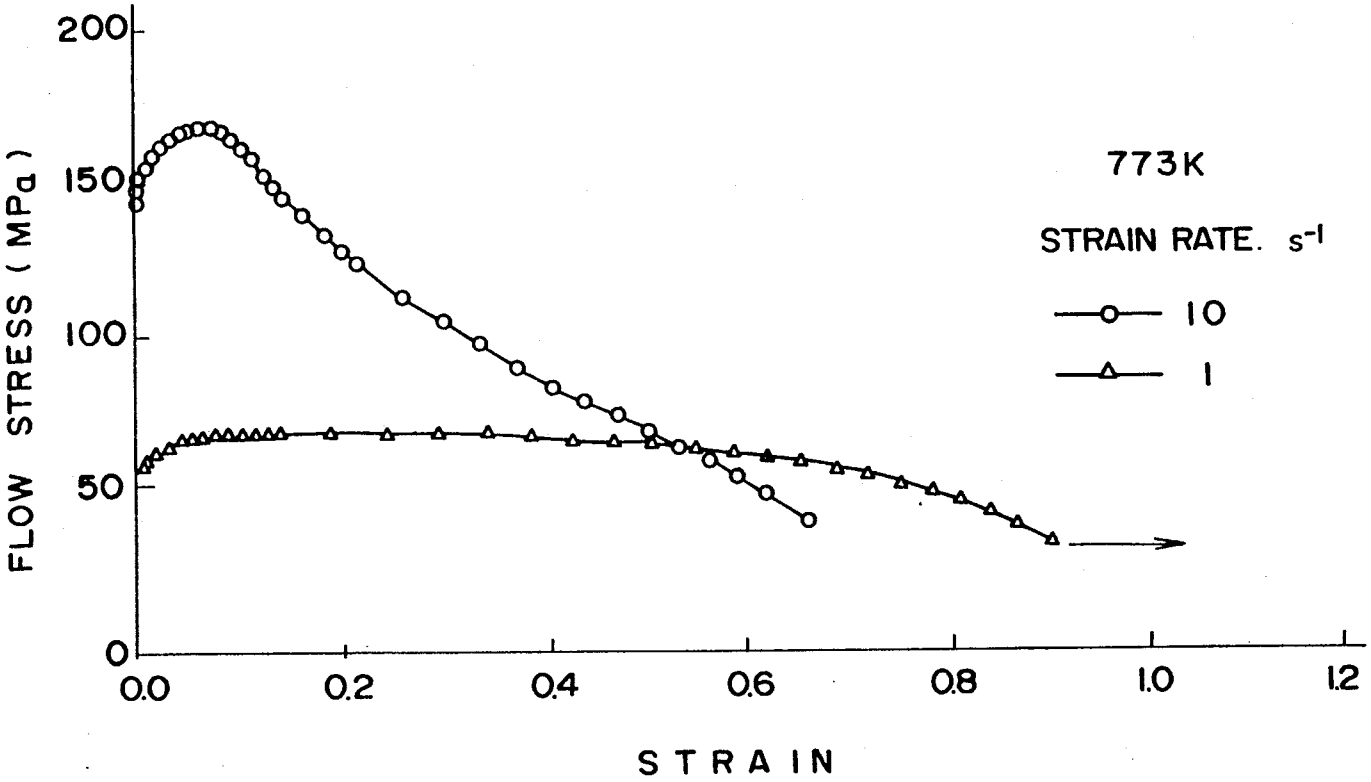
FIG. 1 is a graph showing the relationship of flow stress to strain rate at 500° C. obtained in Example 1.

In the superplastic aluminum-based alloy materials of the present invention, the mean crystal grain size of the matrix should be in the range of 0.005 to 1 μm. A mean crystal grain less than 0.005 μm does not provide any further improvement in the elongation. On the other hand, a mean crystal grain size exceeding 1 μm provides an excessively increased deformation stress, thereby rendering deformation work difficult and reducing the elongation. Consequently, it becomes difficult to achieve the objects of the present invention. The mean particle size of the intermetallic compounds uniformly dispersed in the matrix should be in the range of 0.001 to 0.1 μm. When the mean particle size of the intermetallic compounds dispersed in the matrix is less than 0.001 μm, dissolution of the intermetallic compounds occurs again and induces coarsening of crystal grains. As a result, the deformation stress becomes too high and deformation working becomes difficult. On the other hand, a mean particle size exceeding 0.1 μm makes grain boundary sliding difficult due to such a large particle size and causes coarsening of crystal grains at an elevated temperature. Consequently, the objects contemplated by the present invention cannot be achieved.

The starting alloy material to be formed into the superplastic aluminum-based alloy materials of the present invention should be composed of an amorphous phase, a microcrystalline phase or a mixture thereof and the starting materials and the superplastic aluminum-based ally materials obtained therefrom preferably have the compositions represented by the above-specified general formulae.

In the foregoing general formulae, element $M_1$ is at least one element selected from the group consisting of Mn, Fe, Co, Ni and Mo. When the element $M_1$ is contained in coexistence with element X in the aluminum-based alloy obtained by rapid solidification, it is effective in improving the amorphizing capability and increasing the crystallization temperature of the amorphous phase. As a further effect to be noted herein, the element $M_1$ has an considerable effect in improving the hardness and strength of an amorphous phase. Element $M_2$, which is at least one element selected from the group consisting of V, Cr, and W, has, besides similar effects to the $M_1$ element, an effect of stabilizing a microcrystalline phase formed under the production conditions of microcrystalline alloys. The element $M_2$ forms intermetallic compounds with other alloying elements and uniformly and finely disperses throughout the matrix phase, thereby considerably improving the hardness and strength of the resultant alloy and inhibiting coarsening of fine crystal grains at elevated temperatures. Thus, a microstructure suitable for superplastic working can be obtained. Element $M_3$, which is at least one element selected from the group consisting of Li, Ca, Mg, Si, Cu and Zn, easily dissolves in the state of a solid solution in the aluminum matrix and, thereby, strengthens the matrix. Further, the element $M_3$ is effective in strengthening the alloy material in the case where the alloy material is subjected to solution heat treatment and artificial aging after superplastic working.

Element X is at least one element selected from the group consisting of Nb, Hf, Ta, Y, Zr, Ti, rare earth elements and Mm (misch metal which is a mixture of rare earth elements). In the aluminum alloy obtained by rapid solidification, the element X serves to improve the amorphizing capability as well as to increase the crystallization temperature of the amorphous phase. Owing to such advantageous effects, a considerably improved corrosion resistance can be obtained and the amorphous phase can be stably retained up to a high temperature. Further, under the conditions for the production of microcrystalline alloys, the element X forms intermetallic compounds in combination with the other coexisting elements and, thereby, provides a stabilized microcrystalline phase and a high strength to the resultant alloys.

In the superplastic aluminum-based alloy materials of the present invention represented by the above general formulae hereinbefore defined, a, b, c, d and e are limited by atom percent to the ranges of 75 to 97% , 0.5 to 15%, 0.1 to 5%, 0.5 to 5% and 0.5 to 10% because proportions outside these ranges make it difficult to form an amorphous phase or a supersaturated solid solution exceeding the solid solution limit in the rapidly solidified aluminum-based alloy.

The second aspect of the present invention is directed to a process for producing the above-mentioned superplastic aluminum-based alloy material by obtaining an aluminum-based alloy material consisting of an amorphous phase, a microcrystalline phase or a mixed phase thereof by rapidly quenching an alloy material having a particular composition as previously specified and then subjecting the alloy material to a single or combined thermo-mechanical treatment after or without heat treatment at a prescribed temperature for a prescribed period of time so as to develop the above-mentioned microstructure, which renders the materials suited to superplastic working, in the resultant superplastic aluminum-based alloy materials.

In the production process, the aluminum-based alloy materials having the same compositions as specifically described in the first aspect of the present invention may be also used as preferable starting materials.

The heat treatment and thermo-mechanical treatment (e.g., rolling, extrusion or the like) make it possible to obtain the superplastic materials consisting of a fine-grained crystalline structure which permits smooth grain boundary migration or sliding and the resultant superplastic materials have been proved to exhibit large elongation properties at relatively large strain rates. The heat treatment conducted prior to the thermo-mechanical treatment is required for crystallization of the alloy material having an amorphous phase and, thus, when the alloy material obtained by rapidly quenching is composed of a microcrystalline phase, this heat treatment can be omitted. The prescribed temperature and time of the heat treatment are preferably in the range of the crystallization temperature $(Tx)+100\pm50°$ C. and in the range of 0.5 to 5 hours, respectively. The temperature and time of the thermo-mechanical treatment are preferably in the range of the crystallization temperature $(Tx)\pm150°$ C. and in the range of 0.1 to 1 hour, respectively.

Since the elements represented by $M_1$ and $M_2$ in the general formulae have a relatively small ability to diffuse into the aluminum matrix, the particle sizes of intermetallic compounds formed from these elements do not grow to coarse particles during the above heat treatment. The intermetallic compounds are uniformly dispersed in the alloy in such a manner that they exhibit a pinning effect of inhibiting the crystal growth of the matrix. When imparting strain to the alloy material by thermo-mechanical treatment (e.g., plastic working) prior to the heat treatment, a dislocation network, which provides many nucleating sites for the formation of intermetallic compounds, is formed in the aluminum matrix and enhances the uniform dispersion of fine intermetallic compounds made up of the elements represented by $M_1$, $M_2$ and $M_3$ in the general formulae, thereby inhibiting coarsening of crystal grains of the matrix as well as improving the strength of the alloy.

Since the above-mentioned production process regulates the crystal grain size of the alloy material consisting of an amorphous phase, a microcrystalline phase of sizes of about 5 to 30 nm or a mixed phase thereof Go the range of 0.005 to 1 μm, grain size regulation can be easily achieved with finer grain sizes as compared with a working-recrystallization process usually used for the grain size regulation of conventional superplastic materials. Similar effects can also be observed in the intermetallic compounds dispersed within the crystal grains of the matrix and intermetallic compound particle size can be easily regulated by the heat treatment or thermo-mechanical treatment.

Since the alloy material obtained by the present invention has an excellent heat resistance and is not subject to crystal growth, even at high temperatures, fine crystal grains and intermetallic compound particles can be formed after the thermo-mechanical treatment and good high-temperature strength properties can be obtained. Further, by subjecting the alloy material to the heat treatment and thermo-mechanical treatments according to the present invention, superplastic alloy materials having a fine-grained crystalline microstructure, which permits smooth grain boundary migration or sliding, can be obtained. The thus obtained materials has been found to exhibit a large elongation at a relatively large strain rate.

The superplastic aluminum-based alloy material of the present invention can also be obtained from a starting material consisting of a microcrystalline structure with a mean crystal grain size of 1 μm or less by regulating the mean crystal grain size and the mean particle size of dispersed intermetallic compounds to the above-specified ranges.

The present invention will hereinafter be described specifically on the basis of the following examples.

EXAMPLE 1

Powder having a composition of $Al_{88.5}Ni_8Mm_{3.5}$ was produced with a mean particle diameter of 13 μm by gas atomizing. The resultant powder consisted of an amorphous phase and a fine-grained aluminum solid solution phase with a mean grain size of 10 to 200 nm. The powder was filled in a copper metal capsule of 40 mm in outer diameter and 1 mm in wall thickness, then thermally treated at 400° C. for 3 hours, and formed into an extrusion billet by pressing at a pressure of 200 MPa. In this stage, crystallization proceeded to the degree where the mean crystal grain size of the matrix and the mean particle size of the dispersed intermetallic compound phase were regulated to 0.1 to 0.3 μm and 0.05 μm or less, respectively. The billet thus produced was extruded at 360° C. to produce an extruded bar, 12 mm in diameter, with an extrusion ratio of 10. In this stage, the mean crystal grain size of the A1 matrix phase and the mean particle size of the intermetallic compounds were the same as in the above extrusion billet and no change was detected. The tensile strength of the as-extruded bar was measured and was found to be 910 MPa.

The extruded bar was machined into tensile specimens (measuring part: 3 mm in diameter) and subjected to tensile deformation at each strain rate of $10^0s^{-1}$, $10^1s^{-1}$ and $10^2s^{-1}$ and each testing temperatures of 400° C., 500° C. and 600° C. The test results are shown in Table 1 below.

TABLE 1

| Temperature (°C.) | Elongation (%) Strain rate ($s^{-1}$) $10^0$ | $10^1$ | $10^2$ |
|---|---|---|---|
| 400 | 60 | 100 | — |
| 500 | 400 | 300 | 100 |
| 600 | 600 | 330 | 80 |

As is shown in Table 1, it was found that large elongations could be ensured, even at high strain rates. Further, the flow stress values of the specimens at 500° C. were about 60 MPa at $10^0s^{-1}$ and 170 to 50 MPa at $10^1s^{-1}$ (see FIG. 1). In this stage, a slight grain growth occurred in the structure of the specimens. However, in the case where the tensile deformation at 500° C. and at $10^1s^{-1}$ was interrupted at a point of a deformation amount of 300%, the deformed specimen showed a tensile strength of 870 MPa at room temperature without any substantial strength reduction.

EXAMPLE 2

200 g of the same powder as set forth above was weighed and put into a 2 liter vessel made of stainless steel for mechanical alloying (MA). The powder was subjected to mechanical alloying operations with 2 kg of stainless steel balls of 10 mm in diameter at a rotation rate of 40 rpm for 3 hours in argon gas. The powder thus obtained was subjected to extruding and tensile working in the same way as described in Example 1. The results are shown in Table 2. In the material subjected to the heal treatments, the mean crystal grain size of the matrix and the mean particle size of the intermetallic compounds were regulated to 0.1 to 0.2 μm and 0.03 μm, respectively. The as-extruded material had a strength of 980 MPa at room temperature and when the same material was deformed up to 300% at a temperature of 500° C. at a strain rate of $10^1s^{-1}$ the deformed material had a strength of 920 MPa. As is shown in the table, it is understood that an improved elongation can be obtained by subjecting the powder to MA. Such effects are attributable to refinement of the matrix and intermetallic compounds and the refinement results from dislocation induced by MA.

TABLE 2

| Temperature (°C.) | Elongation (%) Strain rate ($s^{-1}$) $10^0$ | $10^1$ | $10^2$ |
|---|---|---|---|
| 400 | 120 | 150 | 100 |
| 500 | 1000 | 470 | 280 |
| 600 | 700 | 400 | 250 |

EXAMPLE 3

In the same manner as set forth in Example 1, an extruded bar consisting of $Al_{85}Ni_5Y_{10}$ was obtained and machined to tensile specimens having a measuring part of 3 mm in diameter. The tensile specimens were subjected to tensile deformations at temperature of 400° C., 500° C. and 600° C. and at strain rates of $10^{-1}s^{-1}$, $10^0s-1$ and $10^2s^{-1}$. The results are shown in Table 3.

TABLE 3

| Temperature (°C.) | Elongation (%) Strain rate ($s^{-1}$) $10^{-1}$ | $10^0$ | $10^1$ | $10^2$ |
|---|---|---|---|---|
| 400 | 90 | 110 | — | — |

TABLE 3-continued

| Temperature (°C.) | Elongation (%) Strain rate ($s^{-1}$) $10^{-1}$ | $10^0$ | $10^1$ | $10^2$ |
|---|---|---|---|---|
| 500 | 700 | 800 | 1100 | 120 |
| 600 | 900 | 850 | 600 | — |

EXAMPLE 4

In the same manner as set forth in Example 1, 37 different extruded bars were obtained and, similarly to Example 1, they were measured for elongations due to tensile deformations under various temperatures and strain rates. By way of example, the results for a testing temperature of 550° C. are shown in Table 4

TABLE 4

| No. | Composition (at %) | Elongation (%) Strain rate $10^0$ $s^{-1}$ | $10^1$ $s^{-1}$ | $10^2$ $s^{-1}$ |
|---|---|---|---|---|
| 1 | $Al_{78}Ni_{12}Mm_{10}$ | 360 | 750 | 400 |
| 2 | $Al_{88.5}Ni_8Mm_{3.5}$ | 1220 | 1100 | 420 |
| 3 | $Al_{92}Ni_4Fe_1Mm_3$ | 450 | 920 | 650 |
| 4 | $Al_{86}Ni_6Mn_2Mm_6$ | 660 | 860 | — |
| 5 | $Al_{80}Ni_8Fe_3Ce_9$ | 840 | 620 | 300 |
| 6 | $Al_{87}Ni_8Y_5$ | 720 | 980 | 500 |
| 7 | $Al_{80}Ni_{11}Co_1Ce_5Ta_3$ | 500 | 420 | — |
| 8 | $Al_{95.5}Fe_2Zr_{0.5}Mm_2$ | 840 | 620 | 240 |
| 9 | $Al_{93}Ni_2Fe_2Cr_1Mm_2$ | 760 | 640 | 500 |
| 10 | $Al_{88}Ni_5Zn_1Cu_2Mm_4$ | 740 | 920 | 600 |
| 11 | $Al_{91}Fe_3Zn_1Mg_2Si_1Mm_2$ | 1060 | 800 | 450 |
| 12 | $Al_{89.5}Ni_8Zr_{2.5}$ | 670 | 580 | 400 |
| 13 | $Al_{88.5}Ni_8Ti_{3.5}$ | 550 | 400 | 300 |
| 14 | $Al_{89.5}Ni_8Zr_2Mg_{0.5}$ | 760 | 420 | 250 |
| 15 | $Al_{90}Ni_7Zr_2Cu_1$ | 470 | 350 | 320 |
| 16 | $Al_{88}Ni_8Mm_{3.5}Zr_{0.5}$ | 900 | 750 | 600 |
| 17 | $Al_{90.5}Ni_7Mm_{1.5}Zr_1$ | 750 | 850 | 560 |
| 18 | $Al_{91.8}Ni_6Nb_{0.2}Hf_1Ce_1$ | 450 | 750 | 600 |
| 19 | $Al_{92.5}Ni_5Fe_1Zr_1Ta_{0.5}$ | 650 | 720 | 560 |
| 20 | $Al_{90.8}Co_7Mn_{0.2}Y_2$ | 340 | 480 | 450 |
| 21 | $Al_{92.5}Ni_4Mo_1Ti_{2.5}$ | 570 | 660 | 500 |
| 22 | $Al_{95}Ni_1Fe_{0.5}Mm_{3.5}$ | 680 | 770 | 510 |
| 23 | $Al_{93.5}Ni_2V_1Y_{1.5}Ti_2$ | 780 | 800 | 650 |
| 24 | $Al_{88}Ni_8Cr_{0.5}Fe_1Mm_{2.5}$ | 500 | 650 | 450 |
| 25 | $Al_{87.2}Ni_{10}Co_{0.2}W_{0.1}Mo_{0.5}Nb_1Zr_1$ | 470 | 580 | 510 |
| 26 | $Al_{86.3}Ni_9Mn_1V_{0.5}Ta_{0.2}Mm_3$ | 880 | 720 | 340 |
| 27 | $Al_{86.7}Ni_9V_{0.2}Cr_2Hf_{0.1}Ti_2$ | 560 | 650 | 450 |
| 28 | $Al_{92.1}Ni_4Fe_{0.2}Li_1Mg_{0.2}Nb_{0.5}Mm_2$ | 770 | 560 | 350 |
| 29 | $Al_{90.7}Ni_5Mo_{0.1}Ca_{0.2}Hf_{0.5}Ti_{3.5}$ | 620 | 780 | 560 |
| 30 | $Al_{87}Co_8Si_1Cu_2Nb_1Zr_1$ | 780 | 920 | 680 |
| 31 | $Al_{91}Mn_2Mg_2Zn_1Y_4$ | 680 | 860 | 710 |
| 32 | $Al_{88}Ni_7Mg_1Zn_1Ta_2Ce_1$ | 450 | 580 | 510 |
| 33 | $Al_{88}Ni_5Fe_1V_1Li_{0.5}Nb_2Mm_{2.5}$ | 490 | 560 | 460 |
| 34 | $Al_{87.5}Ni_7Co_1Cr_{0.5}Ca_{0.5}Hf_1Ti_{2.5}$ | 660 | 780 | 710 |
| 35 | $Al_{88}Mn_6W_1Mg_1Si_1Ta_1Zr_2$ | 620 | 770 | 700 |
| 36 | $Al_{87.2}Ni_{10}Mo_{0.2}V_{0.1}Cr_{0.2}Cu_{0.2}Mg_{0.1}Y_2$ | 700 | 650 | 540 |
| 37 | $Al_{88.7}Ni_8Cr_1Mg_{0.2}Zn_{0.1}Ce_2$ | 710 | 890 | 710 |

EXAMPLE 5

Figure 2:
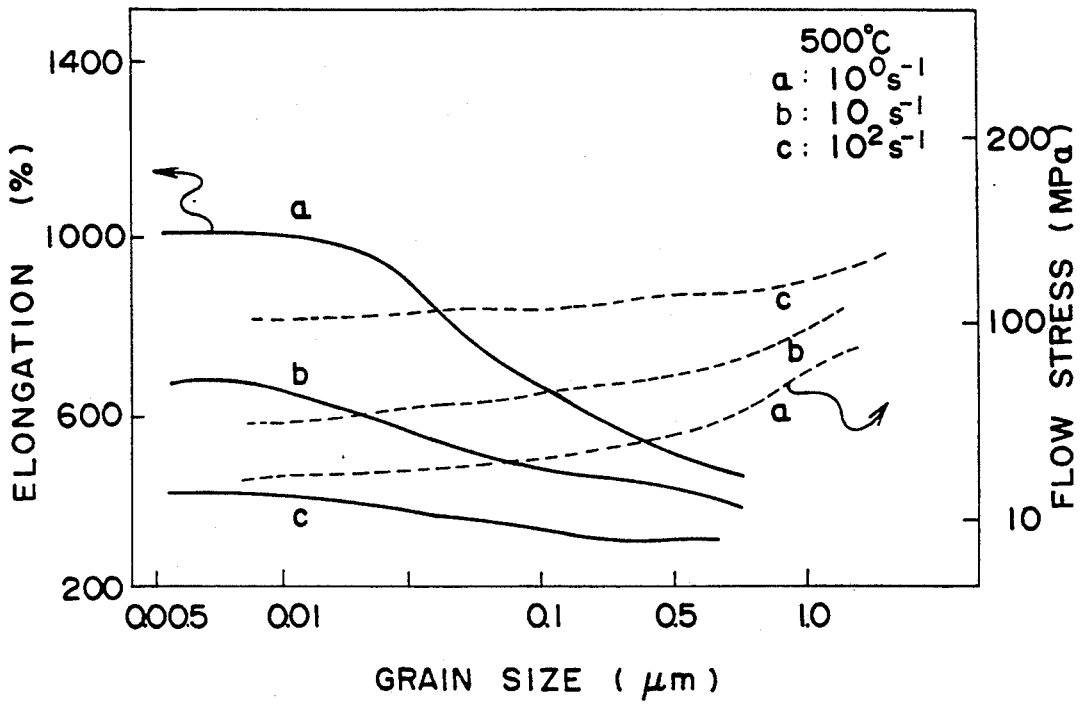
FIG. 2 is a graph showing the relationship of grain size, flow stress and elongation obtained in Example 5.
Figure 3:
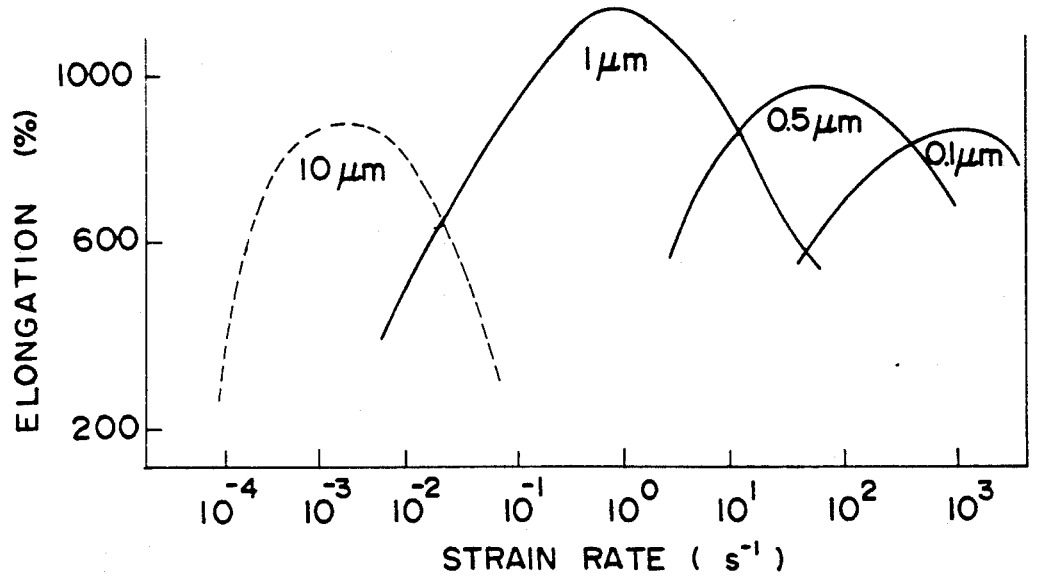
FIG. 3 is a graph showing the relationship of grain size, strain rate and elongation obtained in Example 5.

$Al_{88.5}Ni_5Fe_2Zr_1Mm_{3.5}$ alloy powder was produced by gas atomizing. Test specimens were prepared from the alloy powder in the same manner as set forth in Example 1 except that the thermal treating temperature and extruding temperature were changed to vary the crystal grain size of the matrix. The specimens were examined for the effects of strain rates on their elongations depending on the variations in their crystal grain sizes. The results are shown in FIGS. 2 and 3.

As is shown in these figures, large elongations could be obtained even if the strain rates were increased and the elongations became large with a decrease in the grain size. On the other hand, the flow stress values showed a tendency to lower with a decrease in the grain size.

As has been stated, the superplastic aluminum-based alloy materials of the present invention are suitable for working at a relatively high speed, such as high-speed forging, high-speed bulging, high-speed rolling, high-speed drawing, etc., and can be formed into complicated shapes by these high-speed workings while maintaining the advantageous properties, such as high strength and heat resistance, of rapidly solidified alloys. Thus, the superplastic aluminum-based alloy materials are industrially very useful. Further, according to the production process of the present invention, such superior superplastic aluminum-based alloy materials can be easily produced.

What is claimed is:

1. A superplastic aluminum-based alloy material consisting of a matrix formed of aluminum or a supersaturated aluminum solid solution, whose average crystal grain size is 0.005 to 1 μm, and particles made of a stable or metastable phase of various intermetallic compounds formed of a main alloying element making up the matrix and other alloying elements and/or of various intermetallic compounds formed of the other alloying elements and distributed evenly in the matrix, said particles having a mean particle size of 0.001 to 0.1 μm and said superplastic aluminum-based alloy material exhibiting a large elongation at high strain rates of $10^{-1}s^{-1}$ or larger and consisting of a composition represented by the general formula: $Al_aM_{1b}X_e$, wherein $M_1$ is at least one element selected from the group consisting of Mn, Fe, Co, Ni and Mo; X is at least one element selected from the group consisting of Nb, Hf, Ta, Y, Zr, Ti, rare earth elements and a mixture of rare earth elements; and a, b and e are in atomic percentages, $75 \leqq a \leqq 97$, $0.5 \leqq b \leqq 15$ and $0.5 \leqq e \leqq 10$.

2. The superplastic aluminum-based alloy material of claim 1, wherein the superplastic aluminum-based alloy material exhibits a large elongation at a strain rate of $10^{-1}s^{-1}$ at a temperature of at least 400° C.

3. The superplastic aluminum-based alloy material of claim 1, wherein the superplastic aluminum-based alloy material is suitable for high speed working.

4. A superplastic aluminum-based alloy material consisting of a matrix formed of aluminum or a supersaturated aluminum solid solution, whose average crystal grain size is 0.005 to 1 μm, and particles made of a stable or metastable phase of various intermetallic compounds formed of a main alloying element making up the matrix and other alloying elements and/or of various intermetallic compounds formed of the other alloying elements and distributed evenly in the matrix, said particles having a mean particle size of 0.001 to 0.1 μm and said superplastic aluminum-based alloy material exhibiting a large elongation at high strain rates of $10^{-1}s^{-1}$ or larger and consisting of a composition represented by the general formula: $Al_aM_{1(b-c)}M_{2c}X_e$, wherein $M_1$ is at least one element selected from the group consisting of Mn, Fe, Co, Ni and Mo; $M_2$ is at least one element selected from the group consisting of V, Cr and W; X is at least one element selected from the group consisting of Nb, Hf, Ta, Y, Zr, Ti, rare earth elements and a mixture of rare earth elements; and a, b, c and e are, in atomic percentages $75 \leqq a \leqq 97$, $0.5 \leqq b \leqq 15$, $0.1 \leqq c \leqq 5$ and $0.5 \leqq e \leqq 10$.

5. The superplastic aluminum-based alloy material of claim 4, wherein the superplastic aluminum-based alloy material exhibits a large elongation at a strain rate of $10^{-1}s^{-1}$ at a temperature of at least 400° C.

6. The superplastic aluminum-based alloy material of claim 4, wherein the superplastic aluminum-based alloy material is suitable for high speed working.

7. A process for producing a superplastic aluminum-based alloy material which exhibits a large elongation at high strain rates of $10^{-1}s^{-1}$ or larger, the process comprising:

forming an aluminum-based alloy consisting of an amorphous phase, a microcrystalline phase or a mixed phase thereof by rapidly quenching an alloy material having a particular composition, said particular composition being represented by the general formula: $Al_aM_{1b}X_e$, wherein $M_1$ is at least one element selected from the group consisting of Mn, Fe, Co, Ni and Mo; X is at least one element selected from the group consisting of Nb, Hf, Ta, Y, Zr, Ti, rare earth elements and a mixture of rare earth elements; and a, b and e are, in atomic percentages, $75 \leqq a \leqq 97$, $0.5 \leqq b \leqq 15$ and $0.5 \leqq e \leqq 10$;

optionally, heat treating the aluminum-based alloy; and subjecting the aluminum-based alloy to a single or combined thermo-mechanical treatment to provide a material having a microstructure suitable for superplastic working, in which said microstructure consists of a matrix formed of aluminum or a supersaturated aluminum solid solution, whose average crystal grain size is 0.005 to 1 μm, and particles made of a stable or metastable phase of various intermetallic compounds formed of a main alloying element making up the matrix and other alloying elements and/or of various intermetallic compounds formed of the other alloying elements and distributed evenly in the matrix, said particles having a mean particle size of 0.001 to 0.1 μm.

8. The process for producing the superplastic aluminum-based alloy material of claim 7, wherein the superplastic aluminum-based alloy material exhibits a large elongation at a strain rate of $10^{-1}s^{-1}$ at a temperature of at least 400° C.

9. The process for producing the superplastic aluminum-based alloy material of claim 7, wherein the superplastic aluminum-based alloy material is suitable for high speed working.

10. A process for producing a superplastic aluminum-based alloy material which exhibits a large elongation at high strain rates of $10^{-1}s^{-1}$ or larger, the process comprising:

forming an aluminum-based alloy consisting of an amorphous phase, a microcrystalline phase or a mixed phase thereof by rapidly quenching an alloy material having a particular composition, said particular composition being represented by the general formula: $Al_aM_{a(b-c)}M_{2c}X_e$, wherein $M_1$ is at least one element selected from the group consisting of Mn, Fe, Co, Ni and Mo; $M_2$ is at least one element selected from the group consisting of V, Cr and W; X is at least one element selected from the group consisting of Nb, Hf, Ta, Y, Zr, Ti, rare earth elements and a mixture of rare earth elements; and a, b, c and e are, in atomic percentages, $75 \leqq a \leqq 97$, $0.5 \leqq b \leqq 15$, $0.1 \leqq c \leqq 5$ and $0.5 \leqq e \leqq 10$;

optionally, heat treating the aluminum-based alloy; and subjecting the aluminum-based alloy to a single or combined thermo-mechanical treatment to provide a material having a microstructure suitable for superplastic working, in which said microstructure consists of a matrix formed of aluminum or a supersaturated aluminum solid solution, whose average crystal grain size is 0.005 to 1 μm, and particles made of a stable or metastable phase of various intermetallic compounds formed of a main alloying element making up the matrix and other alloying elements and/or of various intermetallic compounds formed of the other alloying elements and distributed evenly in the matrix, said particles having a mean particle size of 0.001 to 0.1 μm.

11. The process for producing the superplastic aluminum-based alloy material of claim 10, wherein the superplastic aluminum-based alloy material exhibits a large elongation at a strain rate of $10^{-1}s^{-1}$ at a temperature of at least 400° C.

12. The process for producing the superplastic aluminum-based alloy material of claim 10, wherein the superplastic aluminum-based alloy material is suitable for high speed working.

13. A process for producing a superplastic aluminum-based alloy material exhibiting a large elongation at high strain rates of $10^{-1}s^{-1}$ or larger, the process comprising:

forming an aluminum-based alloy consisting of an amorphous phase or a mixed phase of an amorphous phase and a microcrystalline phase by rapidly quenching an alloy material having a particular composition, said particular composition being represented by the general formula: $Al_aM_{1b}X_e$, wherein $M_1$ is at least one element selected from the group consisting of Mn, Fe, Co, Ni and Mo; X is at least one element selected from the group consisting of Nb, Hf, Ta, Y, Zr, Ti, rare earth elements and a mixture of rare earth elements; and a, b and e are, in atomic percentages $75 \leqq a \leqq 97$, $0.5 \leqq b \leqq 15$ and $0.5 \leqq e \leqq 10$;

heat treating the aluminum-based alloy at the crystallization temperature, Tx, $+100 \pm 50°$ C. for 0.5 to 5 hours; and subjecting the aluminum-based alloy to a single or combined thermo-mechanical treatment at the crystallization temperature, Tx, $\pm 150°$ C. for 0.1 to 1 hour to provide a material having a microstructure suitable for superplastic molding, in which said microstructure consists of a matrix formed of aluminum or a supersaturated aluminum solid solution, whose average crystal grain size is 0.005 to 1 μm, and particles made of a stable or metastable phase of various intermetallic compounds formed of a main alloying element making up the matrix and the alloying elements and/or of various intermetallic compounds formed of a main alloying element making up the matrix and other alloying elements and/or of various intermetallic compounds formed of the other alloying elements and distributed evenly in the matrix, said particles having a mean particle size of 0.001 to 0.1 μm.

14. The process for producing the superplastic aluminum-based alloy material of claim 13, wherein the superplastic aluminum-based alloy material exhibits a large elongation at a strain rate of $10^{-1}s^{-1}$ at a temperature of at least 400° C.

15. The process for producing the superplastic aluminum-based alloy material of claim 13, wherein the superplastic aluminum-based alloy material is suitable for high speed working.

16. A process for producing a superplastic aluminum-based alloy material exhibiting a large elongation at high strain rates of $10^{-1}s^{-1}$ or larger, the process comprising:

forming an aluminum-based alloy consisting of an amorphous phase or a mixed phase of an amorphous phase and a microcrystalline phase by rapidly quenching an alloy material having a particular composition, said particular composition being represented by the general formula: $Al_aM_{1(b-c)}M_{2c}X_e$, wherein $M_1$ is at least one element selected from the group consisting of Mn, Fe, Co, Ni and Mo; $M_2$ is at least one element selected from the group consisting of V, Cr and W; X is at least one element selected from the group consisting of Nb, Hf, Ta, Y, Zr, Ti, rare earth elements and a mixture of rare earth elements; and a, b, c and e are, in atomic percentages, $75 \leqq a \leqq 97$, $0.5 \leqq b \leqq 15$, $0.1 \leqq c \leqq 5$ and $0.5 \leqq e \leqq 10$;

heat treating the aluminum-based alloy at the crystallization temperature, Tx, $+100 \pm 50°$ C. for 0.5 to 5 hours; and subjecting the aluminum-based alloy to a single or combined thermo-mechanical treatment at the crystallization temperature, Tx, $\pm 150°$ C. for 0.1 to 1 hour to provide a material having a microstructure suitable for superplastic molding, in which said microstructure consists of a matrix formed of aluminum or a supersaturated aluminum solid solution, whose average crystal grain size is 0.005 to 1 $\mu$m, and particles made of a stable of metastable phase of various intermetallic compounds formed of a main alloying element making up thematrix and other alloying elements and/or of various intermetallic compounds formed of a main alloying element making up the matrix and other alloying elements and/or of various intermetallic compounds formed of the other alloying elements and distributed evenly in the matrix, said particles having a mean particle size of 0.001 to 0.1 $\mu$m.

17. The process for producing the superplastic aluminum-based alloy material of claim 16, wherein the superplastic aluminum-based alloy material exhibits a large elongation at a strain rate of $10^{-1}s^{-1}$ at a temperature of at least 400° C.

18. The process for producing the superplastic aluminum-based alloy material of claim 16, wherein the superplastic aluminum-based alloy material is suitable for high speed working.

* * * * *

UNITED STATES PATENT AND TRADEMARK OFFICE

CERTIFICATE OF CORRECTION

PATENT NO. : 5 332 456

DATED : July 26, 1994

INVENTOR(S) : Tsuyoshi MASUMOTO

It is certified that error appears in the above-indentified patent and that said Letters Patent is hereby corrected as shown below:

Column 9, line 56; change "$A1_aM_{a(b-c)}M_{2c}X_e$," to

---$A1_aM_{1(b-c)}M_{2c}X_e$,---.

Column 10, line 53; change "and the alloying" to

---and other alloying---.

Column 12, line 6; change "stable of" to ---stable or---.

line 8; change "thematrix" to ---the matrix---.

Signed and Sealed this

Fifteenth Day of November, 1994

*Attest:*

BRUCE LEHMAN

*Attesting Officer*

*Commissioner of Patents and Trademarks*